US006405715B2

(12) United States Patent
Aubert

(10) Patent No.: US 6,405,715 B2
(45) Date of Patent: Jun. 18, 2002

(54) MASS FLOW DETERMINATION

(75) Inventor: Richard Aubert, Belgrave South (AU)

(73) Assignee: Aubert Electronics Limited, Belgrave South (AU)

( * ) Notice: Subject to any disclaimer, the term of this patent is extended or adjusted under 35 U.S.C. 154(b) by 0 days.

(21) Appl. No.: 09/741,653

(22) Filed: Dec. 20, 2000

Related U.S. Application Data

(63) Continuation of application No. 09/331,336, filed as application No. PCT/AU97/00858 on Dec. 19, 1997, now abandoned.

(30) Foreign Application Priority Data

Dec. 20, 1996 (AU) ..... PO 4307

(51) Int. Cl.[7] ..... F02D 41/30
(52) U.S. Cl. ..... 123/494; 73/118.2; 123/480
(58) Field of Search ..... 123/399, 478, 123/480, 486, 494, 336; 73/118.2; 702/45; 701/103

(56) References Cited

U.S. PATENT DOCUMENTS 4,125,015 A * 11/1978 Di Nunzio et al. ..... 73/118.2
4,446,523 A * 5/1984 Reinke ..... 701/103
4,582,031 A * 4/1986 Janetzke et al. ..... 123/339.24
4,907,556 A * 3/1990 Ishii et al. ..... 123/486
4,999,781 A * 3/1991 Holl et al. ..... 701/108
5,270,935 A * 12/1993 Dudek et al. ..... 123/480 X
5,497,329 A * 3/1996 Tang ..... 701/104
5,904,131 A * 5/1999 O Neill et al. ..... 123/683

FOREIGN PATENT DOCUMENTS

WO WO 92/12339 * 7/1992

* cited by examiner

*Primary Examiner*—Tony M. Argenbright
(74) *Attorney, Agent, or Firm*—Edwin D. Schindler

(57) ABSTRACT

A fuel-injected internal combustion engine and a method for calculating mass air flow in the fuel-injected internal combustion engine having an electronic control of the air fuel ratio employing a throttle for air flow control, including a device for sensing air pressure downstream of the throttle. The method for calculating mass air flow includes measuring the speed of the fuel-injected internal combustion engine, measuring the opening of the throttle, and, omputing total intake mass air flow using algorithms, which includes the product of two terms, a first term substantially representing a function of the downstream air pressure and a second term being substantially a function of the speed of said fuel-injected combustion engine and the throttle opening.

14 Claims, 2 Drawing Sheets

MASS FLOW DETERMINATION

Figure 1:
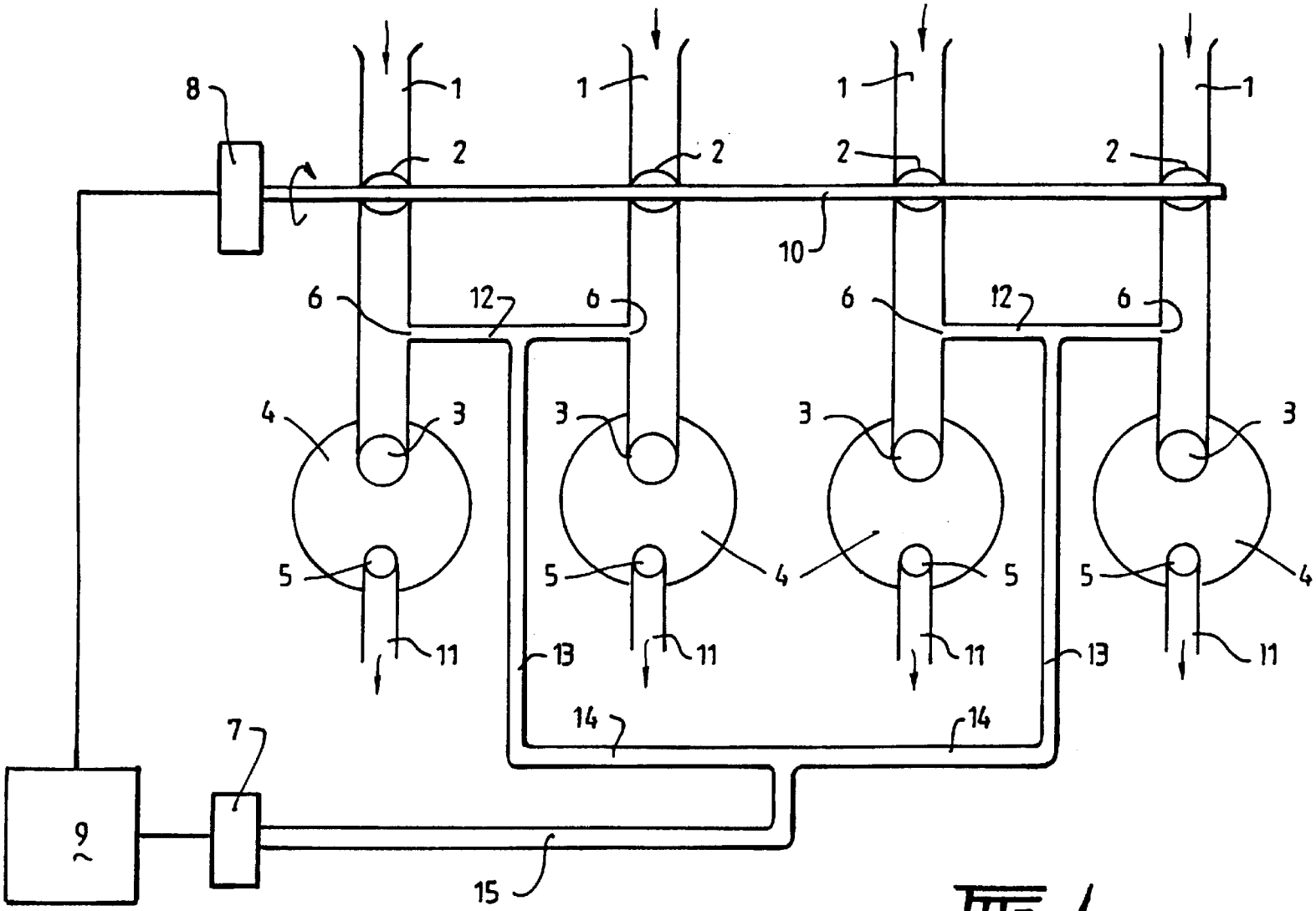

This is a continuation of application Ser. No. 09/331,336, filed Aug. 11, 1999, now abandoned, which represents the U.S. National Phase application of P.C.T. application No. PCT/AU97/00858, filed Dec. 19, 1997.

This invention relates to mass flow determinations primarily intended for a fuel injection system in spark-ignition engines, but which also has other applications. For the purpose of general description, we shall refer to the invention as being applied to the primary application.

The purpose of any fuel delivery system in a spark ignition engine is to achieve as closely as possible a desired air/fuel mixture regardless of engine and ambient air temperature and atmospheric pressure, such mixture requirements being determined by engine speed and load. In modern fuel injection systems used on spark-ignition engines measured fuel delivery is achieved by varying the opening time of solenoid-operated fuel injectors. This time is calculated by a processor which is often part of the total engine management system which system, in turn, requires various engine parameters to be input to supply the data for such calculations.

Calculation of mass flow of air is an essential part of injection systems and various methods have been employed to achieve this.

These include:

1. Mass airflow direct measurement, whereby air pressure is measured by a mass flow sensing device placed in the air induction passage. With a ratio of at least 40:1 and a possible ratio of 150:1 between maximum and minimum mass airflow, this method makes accuracy at low values of flow difficult to achieve. Despite this and other problems this method remains the favoured means of mass air flow determination in road cars.

2. Speed-density control, an indirect method which uses the fact that an engine behaves as a positive displacement air pump. From engine speed, induction air pressure and temperature, as well as atmospheric pressure, this method allows computation of the air mass flow of the engine. This method requires more complex calculations, but yields more consistent results over the range of mass flows. For most engine types this indirect method provides a good estimate of mass air flow under most conditions of engine operation.

The method, however, copes poorly with engine configurations where the throttle is situated in the air induction system in a position relative to the inlet port such that throttle opening affects the velocity and hence the kinetic energy of the incoming air and/or changes the acoustic resonance of the air contained in the air induction system. In spite of the abovementioned limitation of this method it has been in widespread use on many motor vehicles. It has been the preferred indirect method used with forced induction engines.

3. Speed-throttle method. This is also an indirect method which uses the fact that an engine's air consumption can be controlled by an intakes throttling device. From engine speed, throttle opening, ambient air temperature and ambient air pressure, this method allows computation of the air mass flow of the engine. This method requires complex calculations, offers limited accuracy during heavy throttling and is incompatible with most of the additional devices added to modern engines for exhaust emission reduction.

Because the function includes a throttle dependant term this method copes well with engine configurations that incorporate induction systems involving throttle-opening dependent kinetic energy changes and throttle-opening dependent induction-system resonance changes. For this reason it is the indirect method of choice for non-forced induction high performance racing engines.

With no induction pressure term in the calculation, this method is incompatible with forced induction engines.

4. A fourth method the "Speed-density-throttle method", estimates mass airflow from measurements of engine speed, induction air pressure, induction air temperature, throttle opening and ambient air pressure. This method is compatible with almost all engine types yet is rarely if ever employed, because of the difficulties of implementing a calibration strategy that can evaluate the mathematical function for airmass flow, this latter being primarily dependent upon four variables, engine speed, throttle position, induction air temperature and induction air pressure.

It is an object of the invention to overcome the practical difficulties in this last-named fourth method.

The invention in its broadest sense provides a fuel-injected internal combustion engine with electronic control of air fuel ratio employing a throttle for air flow control, means for sensing pressure downstream of such throttle, means for measuring the speed of the engine and means for measuring the opening of such throttle characterised in that the parameters are fed to a processor and the algorithms used by the processor to compute total intake mass air flow contains the product of two terms, one substantially representing a function of the downstream air pressure, as derived from said sensor, and the other being substantially a function of engine speed and throttle opening as determined by said measuring means.

The invention also includes a method of calculating the mass air flow in a fuel-injected internal combustion engine of the kind providing electronic control of air fuel ratio employing a throttle for air flow control, including sensing pressure downstream of such throttle, measuring the speed of the engine and measuring the opening of such throttle characterised in that the algorithms used to compute total intake mass air flow contains the product of two terms, one substantially representing a function of the downstream air pressure, and the other being substantially a function of engine speed and throttle opening as determined.

In many applications, the pressure function can be very simple and can be a linear function based on the sensor reading. Alternatively, for some engines, it can be a more complex function and, if this is the case, it may be necessary to develop a look-up table based on different pressure values.

In order that the invention may be more readily understood, reference shall be made to the accompanying drawings, in which:

FIG. 1. Shows schematically a four cylinder engine having a throttle associated with the air inlet for each cylinder; and FIG. 2. Shows schematically a four cylinder engine having a single throttle and a manifold which feeds the air inlets for each cylinder FIG. 1 shows the components of the system as applied to an engine which uses separate air intake 1 and throttles 2 for each cylinder of the engine. The throttles 2 are inter connected by a shaft 10 to which each of the throttles are connected and with which they are rotated.

Each air intake is connected by way of inlet valve 3 to a cylinder 4. Each cylinder is shown as having an exhaust valve 5 from which combustion gases may pass to the exhaust system 11.

Each intake has an orifice 6 downstream of the throttle and each orifice is connected by way of pipes 12, 13, 14 and 15 to a pressure transducer 7.

The pressure transducer is connected to a processor 9.

Connected to the throttle shaft is a rotary transducer 8 which provides to the processor, an indication of the position of the throttles.

As indicated, the arrangement is schematic and may be applied to a motor having any number of cylinders, from one upward.

Figure 2:
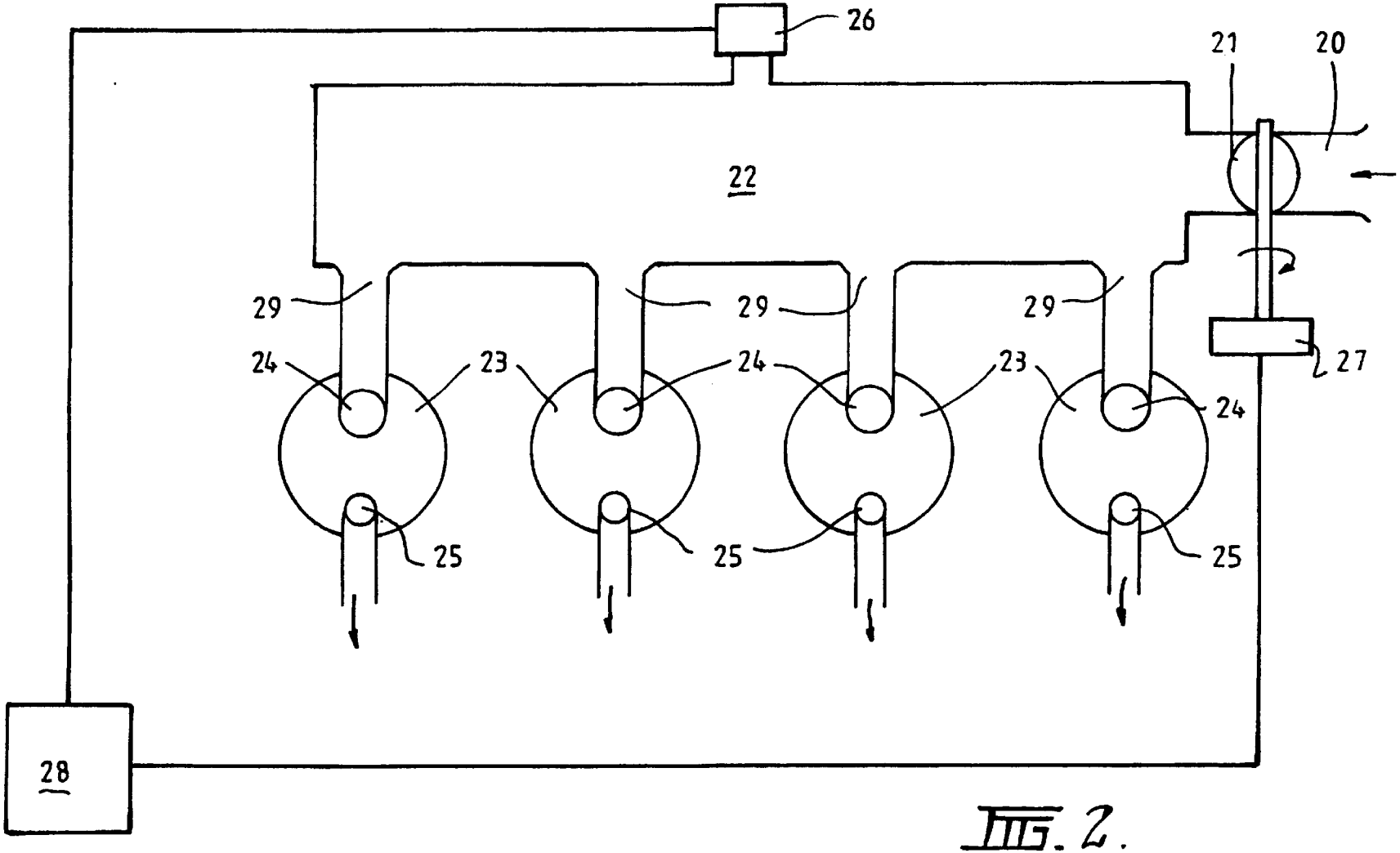

FIG. 2 shows an arrangement for a multi-cylinder engine which has a common manifold for all of the cylinders and a single air intake 20. In this case there is a single throttle 21 at the entry to a manifold 22 having a number of outlets 29 each of which is associated with an inlet valve 24 in a cylinder 23. In this case the exhaust valves 25 permit passage of combustion gasses to the exhaust system.

The pressure transducer 26 is still downstream of the intake and in this case the output from the transducer passes to a processor 28. Again, there is a rotary transducer 27 which provides and indication of the position of the throttle 21.

It will be appreciated that the actual method of applying the concept shown in the schematic representations can be effected in a number of ways. For example the throttle(s) may be butterfly valves, may be sliding or rotary valved. Also, different forms of both the pressure transducers or the processors can be used.

We stated earlier herein the intake mass air flow is the product of two terms, one substantially representing a function of the downstream air pressure, which is derived from the pressure transducer(s), the other being substantially a function of engine speed and throttle position, engine speed being measured conventionally and throttle position which is derived from the rotary transducer associated with the throttle shaft.

The invention is particularly suitable for high performance engines, but not exclusively so.

Of the four parameters mentioned, induction air temperature is easily compensated for, as gas density is inversely proportional to absolute temperature.

However, in order to achieve a relatively simple means of calculating mass air-flow from the three other mentioned mutually independent variables, the invention includes a method of replacing the three-variable-dependent air mass flow function with the product of two variables; one being a function of the induction air pressure as measured by the above-mentioned down-stream pressure sensor, hereinafter referred to as the pressure term, the other being a function of engine speed and throttle opening, hereinafter referred to as the speed throttle term.

In some engines, the speed throttle term, which represents a function of engine speed and throttle opening, becomes very important. This is particularly true in a configuration where the throttle is situated in the air induction system in such a position that throttle opening affects the velocity and thus the kinetic energy of the incoming air and/or changes the acoustic resonance of the air contained within the induction system. These throttle-opening dependent kinetic energy changes and induction system resonance changes can cause considerable changes in mass air flow. The mathematical relationships which occur cannot easily be expressed in a formula, but can be incorporated in a look-up table which is produced by test-running the engine, or a standard engine having the same characteristics.

The pressure term is usually a straight line term, which can be calculated simply from the output from the sensor but, in some applications, this term may also need modification by other minor factors, such modification either being a mathematical relationship to some other parameter or parameters, or another lookup table. However, under most conditions and for most engines, we have found that we can accept this straight line arrangement for the pressure and can calibrate the engine on the base of this parameter being of that form.

However, as the configuration according to the invention yields air flow determinations which are independent of other parameters including engine speed transients, such tests as may be required for producing data and/or calibrating such corrections or modifications may be performed in steady-state step-wise fashion, preferably altering one parameter at a time.

Because of the general form of the pressure term, it is practically not necessary to effect variations in this term when calibrating the engine and thus the setting up of the engine is very much simpler that has conventionally be seen to be the case.

The calibration may take place on a dynamometer or running the vehicle in a road test. If required a computer can be carried in the car which can be used to control the processor of the system whilst it is being set up.

Given the advantages gained by the algorithm according to the invention data derived from such tests will remain valid under the transient conditions inherent in actual vehicle operation. This, as pointed out earlier, was not possible prior to the invention.

In addition to improving on the performance of other systems, the method according to the invention allows the successful use of electronic fuel injection under conditions which have hitherto been found impracticable.

We refer to two examples that have been solved successfully using the new indirect method of the invention.

In the first of these, a multi-cylinder engine of a high performance road car which has a throttle in the induction branch of each cylinder and variable air-bypass around the throttles for automatic idle-speed stabilization could not achieve accurate mixture control by use of the speed-throttle method because of unpredictable mass flow introduced by the air bypass and which engine could not use the speed density-engine speed method because calibration became impossible, due to kinetic and resonance effects in the intake manifold. Successful calibration with equipment using the method according to the invention was achieved without difficulty.

A further case is that of a turbo-charged engine again fitted with one throttle per cylinder. Attempts to use metering systems used hitherto have lead to failure because calibration was found to be impracticable. Again the placement of a pressure sensor down-stream of the throttle, in combination with the algorithm according to the invention, reduces the problems to an insignificant level.

Once constant calibration of the air-flow measurement using the major parameters and, in particular using the speed and throttle opening parameters, is achieved with the method and apparatus according to the invention, compensation for other factors, as mentioned earlier, becomes straightforward, as these extra factors can be allowed for, using simple mathematical relationships with one or other measurable parameters. This is particularly so in compensating for ambient temperature.

Thus the invention allows, for the first time, the calculation of air mass-flow in any engine which places at least one pressure sensor downstream of a throttle, to be reduced to a routine matter, in contradistinction to the approximations, guesswork and lengthy testing hitherto required with other methods, thereby improving performance as well as reducing costs.

The method or evaluating mass air flow described is equally applicable to engines described having a multiplicity of throttles and a downstream pressure sensor or a common throttle and downstream pressure sensor following a plenum through which the air passes before distribution to the cylinders or and engine having a multiplicity of throttles and a downstream pressure sensor for each cylinder.

Whilst the described method of mass flow determination is primarily intended for spark ignition engines, it may also apply to other situation where mass flow needs to be measured, such as a Diesel engine in which variations of the quantity of injected fuel may be controlled by a processor.

I claim:

1. A fuel injected internal combustion engine with electronic control of air fuel ratio employing a throttle for air flow control, having means for sensing pressure downstream of such throttle, means for measuring the speed of the engine and means for measuring the opening of such throttle characterised in that the parameters are fed to a processor and the algorithms used by the processor to compute total intake mass air flow contains the product of two terms, one substantially representing a function of the downstream air pressure, as derived from said sensor, and the other being substantially a function of engine speed and throttle opening as determined by said measuring means.

2. A fuel injected internal combustion engine as claimed in claim 1 wherein there is a throttle for each cylinder, the throttles being adapted to be moved together and a pressure transducer which is actuated by the pressure downstream of each of the throttles.

3. A fuel injected internal combustion engine as claimed in claim 2 wherein there is a pressure outlet from each intake, the outlets being connected by pipes to the pressure transducer.

4. A fuel injected internal combustion engine as claimed in claim 1 wherein there is a single intake and throttle and a manifold from which air passes to each cylinder, the pressure transducer being located in the plenum.

5. A fuel injected internal combustion engine as claimed in claim 1 wherein aspiration is at atmospheric pressure.

6. A fuel injected internal combustion engine as claimed in claim 1 wherein the engine employs forced induction.

7. A fuel injected internal combustion engine as claimed in claim 1 wherein the engine is a spark ignition engine.

8. A fuel injected internal combustion engine as claimed in claim 1 wherein the engine is a diesel engine.

9. A method for calculating mass air flow in a fuel-injected internal combustion engine having an electronic control of air fuel ratio employing a throttle for air flow control, including means for sensing air pressure downstream of said throttle, said method for calculating mass air flow comprising the steps of:

measuring the speed of said fuel-injected internal combustion engine;

measuring the opening of said throttle; and, computing total intake mass air flow using algorithms comprising the product of two terms, a first term of said two terms substantially representing a function of downstream air pressure and a second term of said two terms being substantially a function of the speed of said fuel-injected combustion engine and the throttle opening, as determined in said measuring steps.

10. The method for calculating mass air flow in a fuel-injected internal combustion engine according to claim 9, further comprising a calibration step wherein said downstream air pressure is a straight line term and said calibrating step is substantially effected from said second term of said two terms.

11. The method for calculating mass air flow in a fuel-injected internal combustion engine according to claim 9, further comprising the step of calibrating data by adjusting said second term of said two terms.

12. The method for calculating mass air flow in a fuel-injected internal combustion engine according to claim 11, wherein said step of calibrating data is carried out without consideration of said first term of said two terms.

13. The method for calculating mass air flow in a fuel-injected internal combustion engine according to claim 11, wherein said step of calibrating data is carried out on a dynamometer.

14. The method for calculating mass air flow in a fuel-injected internal combustion engine according to claim 11, wherein said step of calibrating data is carried out under road conditions.

* * * * *